United States Patent [19]

Hsu et al.

[11] Patent Number: 4,807,704

[45] Date of Patent: Feb. 28, 1989

[54] SYSTEM AND METHOD FOR PROVIDING MULTIPLE WELLS FROM A SINGLE WELLBORE

[75] Inventors: Frank H. Hsu; James A. Dech, both of Plano, Tex.

[73] Assignee: Atlantic Richfield Company, Los Angeles, Calif.

[21] Appl. No.: 101,515

[22] Filed: Sep. 28, 1987

[51] Int. Cl.[4] ..... E21B 7/08; E21B 43/14

[52] U.S. Cl. ..... 166/313; 166/384; 166/117.5; 175/61

[58] Field of Search ..... 175/61, 62; 166/313, 166/378, 381, 384, 117, 117.5, 117.6

[56] References Cited

U.S. PATENT DOCUMENTS

| | | | |
|---|---|---|---|
| 3,170,518 | 2/1965 | Brown | 166/313 |
| 4,067,385 | 1/1978 | Schwager et al. | 166/313 |
| 4,304,299 | 12/1981 | Holland et al. | 166/117.5 |
| 4,396,075 | 8/1983 | Wood et al. | 166/117.5 |
| 4,396,230 | 8/1983 | Wood et al. | 166/313 |
| 4,402,551 | 9/1983 | Wood et al. | 175/61 |
| 4,415,205 | 11/1983 | Rehm et al. | 175/61 |

*Primary Examiner*—Jerome W Massie
*Assistant Examiner*—Terry Lee Melius
*Attorney, Agent, or Firm*—Michael E. Martin

[57] ABSTRACT

Multiple wellbores may be extended from a common, generally vertical wellbore and completed for conduction of fluids between said common wellbore and each of said wells by drilling the common wellbore, inserting a seal bore into the common wellbore below the junction of a deviated well with said common wellbore, inserting a whipstock and then drilling the deviated well. The whipstock is removed and a guide member is inserted into the common wellbore and secured to the anchor member. A dual packer is inserted in the common wellbore above the junction of the deviated well and is connected to the guide member to provide a slow passage into the wellbore located below the junction. A second tubing guide connector member is inserted into the common wellbore with a tubing string extending downwardly therefrom. The tubing string is passed through the dual packer and into the deviated well and the second guide member is latched to the dual packer to provide dual flow paths from each of the separate wellbores into the common wellbore or to the surface. The second guide member includes separate configurations for the respective flow passages to permit insertion of tubing strings and separate guide heads into selected wellbores for various well operations.

18 Claims, 4 Drawing Sheets

SYSTEM AND METHOD FOR PROVIDING MULTIPLE WELLS FROM A SINGLE WELLBORE

BACKGROUND OF THE INVENTION

1. Field of the Invention

The present invention pertains to a system and method for drilling deviated or generally horizontally extending wellbores and completing multiple wells from a single generally vertical wellbore.

2. Background

The development of techniques for drilling relatively high angle deviated wells from a generally vertical wellbore has provided several advantages in recovering oil and gas from subterranean formations. One or more deviated or generally horizontal wellbores may be drilled from single generally vertical wellbore to provide wellbores which: (a) reach irregular reservoirs without additional wells being drilled from the surface, (b) limit the invasion of unwanted formation fluids, (c) penetrate natural vertical fractures and (d) improve production from various types of formations or reservoirs.

However, one shortcoming of prior art multiple wellbores pertains to the lack of separation of one wellbore from the other to prevent commingling of fluids or to provide for treatment of one wellbore while precluding the application of the same treatment to other wellbores extending from or comprising part of the single vertical wellbore. It is to this end that the present invention has been developed with the provision of an improved system and method for completing multiple wells from a single generally vertical wellbore. Although the terms vertical, deviated and horizontal are used herein for convenience, those skilled in the art will recognize that the system and method of the invention may be employed with respect to wells which extend in directions other than generally vertical or horizontal.

SUMMARY OF THE INVENTION

The present invention provides an improved system and method for completing plural wellbores which extend from or include a single generally vertical wellbore extending from the earth's surface or other point of drilling and completion operations. In accordance with one aspect of the present invention, a single, generally vertical wellbore is drilled, followed by the drilling of one or more deviated or curved wellbores extending from predetermined points of intersection with the vertical wellbore and completion of the respective wellbores is carried out to provide separate conduits or flow paths for fluids to and from the respective wellbores.

In accordance with another aspect of the present invention a system is provided which includes means for guiding a tubing string inserted into a wellbore to deviate from one wellbore into the other after passing through a packer or other support means for said tubing string and whereby multiple tubing strings may be extended from a junction of two wellbores through said packer or other guide means to the surface or to a suitable connector downhole above which the fluids conducted between said wellbores and the surface may be collected or commingled.

In accordance with a further aspect of the present invention, there is provided an improved system for completing plural wells from a single wellbore which extends to the surface or to a point of operation for producing fluids from or injecting fluids into said plural wellbores. Those skilled in the art will recognize the above-described features and advantages of the present invention together with other superior aspects thereof upon reading the detailed description which follows in conjunction with the drawings.

DESCRIPTION OF PREFERRED EMBODIMENTS

Figure 1:
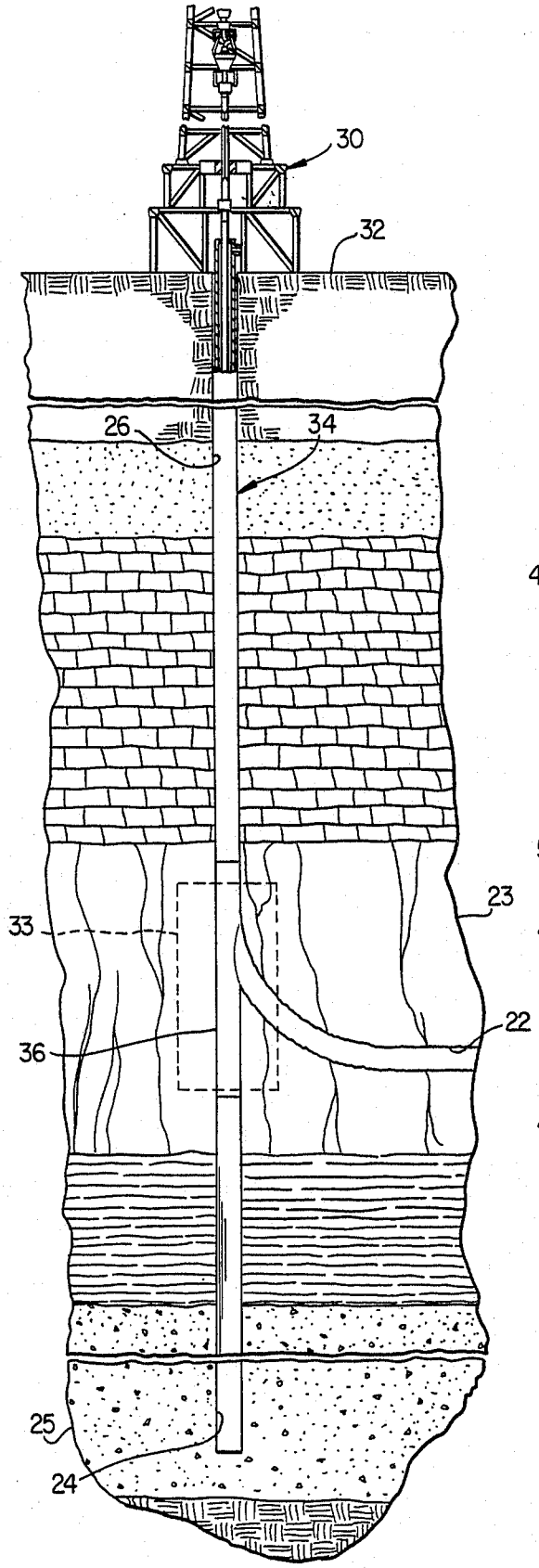
FIG. 1 is a schematic diagram of a well in which two wells have been completed out of a single, generally vertical wellbore.

In the description which follows, like parts are marked throughout the specification and drawing with the same reference numerals, respectively. The drawing figures are not necessarily to scale. Certain features of the invention may be shown exaggerated in scale or in somewhat schematic form and some details of conventional elements may not be shown in the interest of clarity and conciseness.

Referring to FIG. 1, there is illustrated a somewhat schematic diagram of a well 20 in which multiple production or injection wellbores 22 and 24 have been drilled from a single generally vertical wellbore 26. For illustrative purposes only, the wellbore 22 is shown extending generally horizontally through an earth formation region 23 having several generally vertically extending fractures which are intersected by the wellbore 22. The wellbore 24 extends generally vertically downward into a formation region 25 from which it may also be desired to produce or inject fluids. A conventional drilling and equipment handling apparatus 30 is disposed on the earth's surface 32 for drilling the wellbores 22 and 24 from the generally vertically extending wellbore 26 and for running certain components into and out of the wellbores 22 and 24. In the example shown, the wellbore 24 is primarily an extension of the vertical wellbore 26, although the wellbore 24 could extend in other directions in accordance with the method and system of the present invention. FIG. 1 illustrates the outline of a zone 33 which is generally the zone in which the operations and system of the present invention are located as illustrated in FIGS. 2, 3, 4, 7 and 12 of the drawing.

Figure 2:
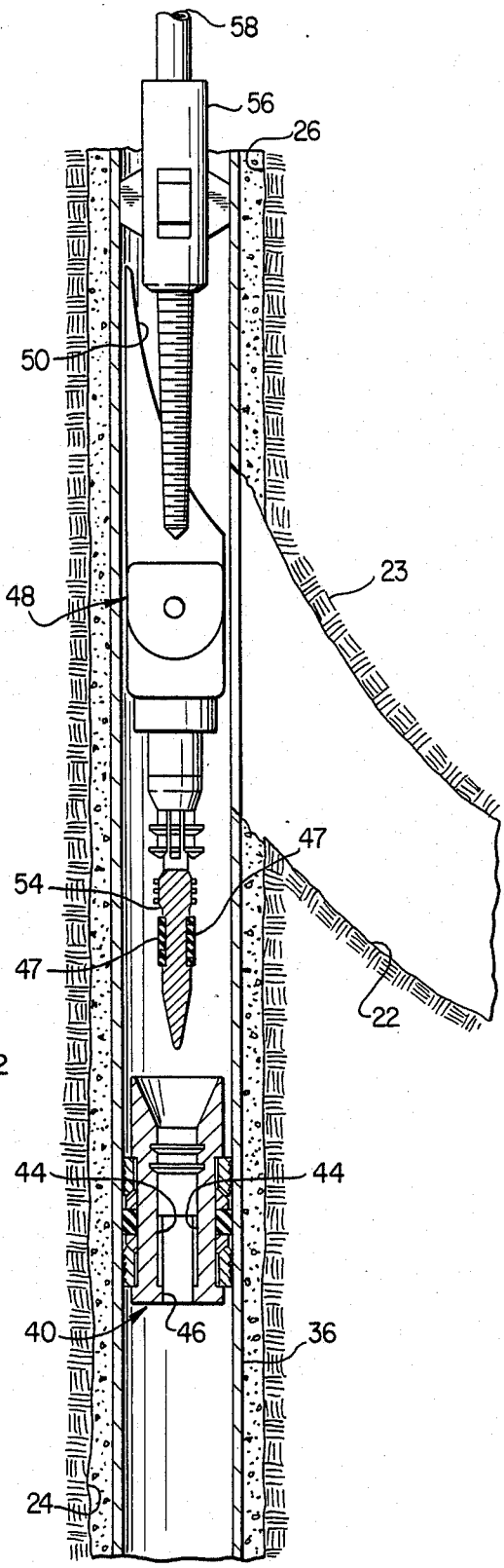
FIG. 2 is a generally vertical section view showing the intersection of the two wellbores and removal of a whipstock tool upon completion of drilling of a deviated or generally horizontal well.

Referring now to FIG. 2 also, the wellbores 24, 26 are provided with a casing 34, FIG. 1, preferably having a light alloy or easily machinable section 36 interposed therein to provide for drilling the wellbore 22 using known techniques for drilling deviated or high angle horizontal wellbores. FIG. 2 illustrates the condition of the intersection of the wellbores 22 and 24 after certain steps have been carried out to form the wellbore 22. In arriving at the point of completion of the wellbores 22 and 24 as illustrated in FIG. 2, the wellbore 24, 26 is drilled first, typically using conventional practices, and the casing 34 is installed, also using conventional practices. The light alloy or easily machinable casing section 36 is set in the wellbores 24, 26 at the point at which the wellbore 22 is desired to be drilled.

A packer 40 of a type commercially available, such as a model D, manufactured by Baker Packers Div., Baker Oil Tools, Inc., Houston, Tex., is installed just below the point of intersection of the wellbores 22 and 24. The packer 40 is modified to include one or more locating means such as longitudinally extending key slots 44 opening into a bore 46 formed in the packer. After setting of the packer 40 in a conventional manner, a whipstock assembly 48 is installed in the wellbore 24, 26 and oriented such that a guide surface 50 provides for guiding casing milling and wellbore drilling tools, both not shown, in a direction to form the wellbore 22. The whipstock assembly 48 also includes a conventional anchor member 54 for anchoring the whipstock in the desired orientation in the wellbore 24, 26 and secured in the packer 40. For example, the anchor member is provided with opposed orientation keys 47 for registration in the keyways 44, respectively.

As previously mentioned, FIG. 2 illustrates the condition of the well 20 after multiple wellbores 24 and 22 have been drilled and the packer 40 left in place in the wellbore 24. The whipstock assembly 48 is shown being withdrawn from the wellbore 26 utilizing a conventional retrieval tool 56 which has been lowered into the wellbore 26 on the end of a tubing string 58. The drilling of the wellbore 22 may follow conventional practices known to those skilled in the art and may also be carried out by an improved method described in U.S. patent application Ser. No. 927,780 filed Nov. 5, 1986 in the name of James A. Dech, et al., and assigned to the Assignee of the present invention.

Figure 3:
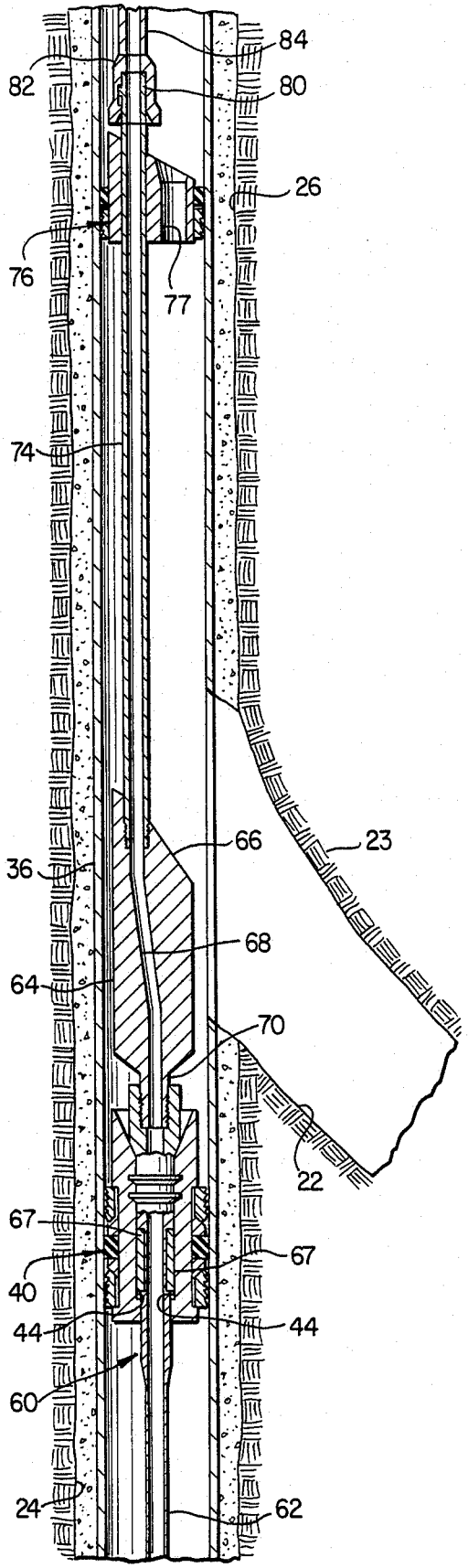
FIG. 3 is a section view taken at the intersection the two wellbores showing the installation of a portion of the system of the present invention.

Referring now to FIG. 3, there is illustrated a portion of the wellbores 22, 24, and 26, within the zone 33, upon completion of additional steps in accordance with the method of the present invention. As shown in FIG. 3, the packer 40 is in receipt of a tubing anchor assembly 60, also of a general type manufactured by Baker Packers Div., which is latched in place in the packer by conventional means. The anchor assembly 60 includes a tubing string 62 extending therefrom and disposed in the wellbore 24 to a depth sufficient to provide for production of fluids from or injection of fluids into the wellbore 24, as desired. The tubing anchor assembly 60 is connected at its upper end to a guide member 64 comprising a generally cylindrical body having a sloping guide surface 66 formed thereon and an internal passage 68 extending from a top edge of the guide member to a lower distal end 70. The distal end 70 may be suitably connected to the anchor assembly 60 such as by a conventional threaded connection. The guide member 64 is adapted to be oriented to have its guide surface 66 placed in position to guide a tubing string into the wellbore 22 by opposed keys 67 on the anchor assembly 60 and which are registered in the keyways 44 in the packer 40.

The upper end of the guide member 64 is connected to an elongated tubing member 74 which extends upward from the guide member and to connection with a dual, hydraulically settable packer, generally designated by the numeral 76. The packer 76 may be of a type commercially available, such as a type A-5 manufactured by Baker Packers Div., and includes a bore 77 for receiving a string of tubing, not shown in FIG. 3. FIG. 3 illustrates one way in which the anchor assembly 60, the guide member 64, the tubing member 74 and the packer 76 may be set into the position shown as an assembly.

The tubing member 74 extends through the packer 76 to an upper end member 80 which comprises part of a releasable, sealing connector assembly. The mating part or member of the connector assembly is designated by the numeral 82 and is releasably connectable to the member 80 by suitable means such as a key and cooperating somewhat J-shaped slot formed in the member 82. The connector or coupling formed by the members 80 and 82 may also be of a type commercially available such as a so-called "on-off" sealing connector manufactured by Baker Packers Division. The connector member 82 is suitably secured to an elongated tubing string 84 which may be lowered into the wellbore 26 to position an assembled combination of the anchor assembly 60, the tubing string 62, the guide member 64, the packer 76, and the tubing member 74. Accordingly, one preferred way of installing the arrangement illustrated in FIG. 3 is to preassemble the anchor assembly 60 with the guide member 66 properly oriented relative to the keys 67 which will register with the keyways 44 in the packer 40. The combination of the anchor assembly 60, the guide member 64 and the packer 76, which is connected to the guide member by the tubing string 74, is lowered into the wellbore into the position illustrated in FIG. 3 by the tubing string 84 and after setting of the packer 76, the tubing string 84 is rotated to release the connection between the connector members 80 and 82 whereby the tubing string 84 may be retrieved so that further operations may be performed as described herein.

Figure 4:
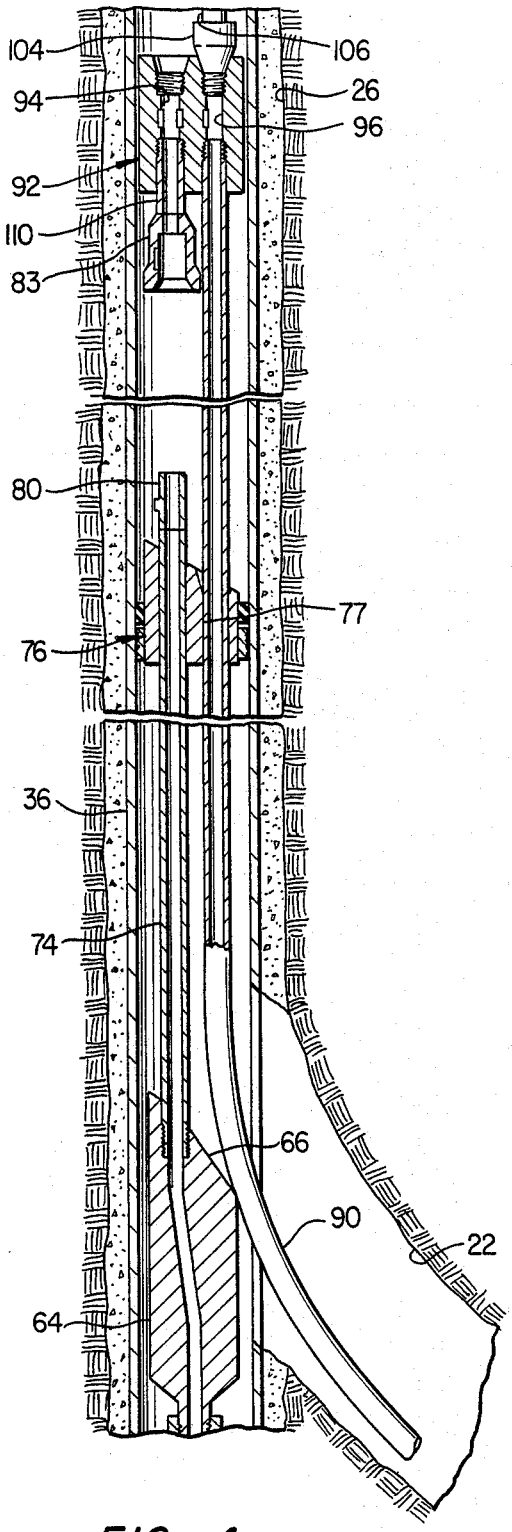
FIG. 4 is a view similar to FIG. 3 showing the installation of a tubing string for the generally horizontal wellbore.
Figure 5:
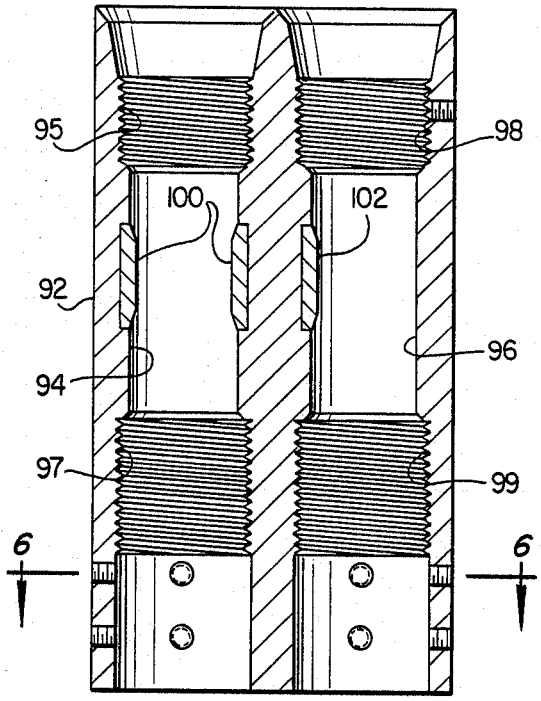
FIG. 5 is a longitudinal section view of a tubing guide and connector member.
Figure 6:
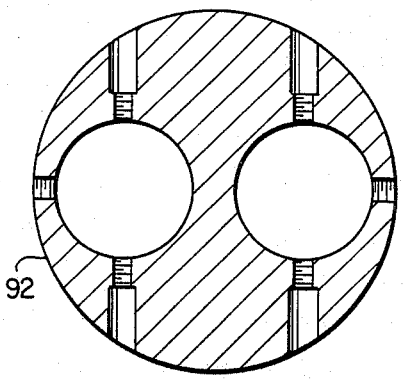
FIG. 6 is a section view taken along the line 6—6 of FIG. 5.

Referring now to FIG. 4, there is illustrated the results of further steps toward completing the wellbore 22 by insertion of a suitable elongated bendable tubing string 90. The tubing string 90 may include various devices, not shown, connected to the lower end thereof, such as a sand screen or liner, a pump, flow control nozzles or other devices useful in certain wellbore operations. The tubing string 90 extends through the bore 77 in the packer 76 and terminates at its upper end in a threaded connection with a tubing guide and connector member 92. The member 92 is a generally cylindrical body, see also FIGS. 5 and 6, having two elongated passages 94 and 96 extending therethrough and terminating in internally threaded portions 95, 97 and 98, 99, respectively. The passages 94 and 96 may be of different diameters or be provided with suitable tubing "go" or "no-go" means to permit or prevent the insertion of a particular tubing string therethrough. For example, opposed keys 100 project into the passage 94 and a single key 102, of a slightly different cross section than the keys 100, projects into the passage 96.

In a preferred way of utilizing the member 92, the tubing string 90 is connected to the lower end thereof and in communication with the passage 96. The opposite end of the member 92 is connected to a threaded coupling 104, FIG. 4, which in turn is connected to a tubing string 106 which may extend to the surface and be utilized to lower the member 92 and the tubing string 90 into the wellbore 26 so that the tubing string 90 may be inserted through the bore 77 in the packer 76 and guided into the wellbore 22. The member 92 is suitably latched to the packer 76 by a connector member 83 which is connected to a predetermined length of tubing 110 threadedly coupled to the member 92 at the threads 97, for example. The connector member 83 is similar to the member 82 but does not require rotation to latch onto the member 80. Accordingly, the tubing string 90 may be inserted into the wellbore 22 using the number 92 and the tubing string 90 may be latched in place by securing the member 92 to the packer 76 through the connector 80, 83. Upon registration of the connector member 80 attached to the tubing 74 with the connector member 83, the tubing string 106 may be disconnected from the member 92 by unthreading the coupling member 104 and retrieving the tubing string 106 and coupling from the wellbore 26.

Figure 7:
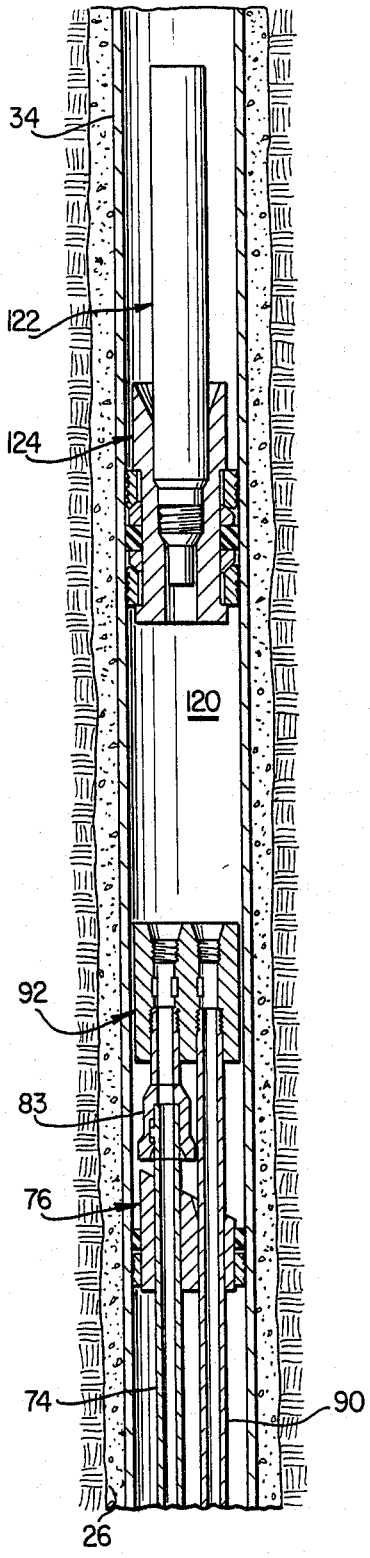
FIG. 7 is a view showing completion of two wells which are in communication with the surface through a single pump located in the generally vertical wellbore.
Figure 12:
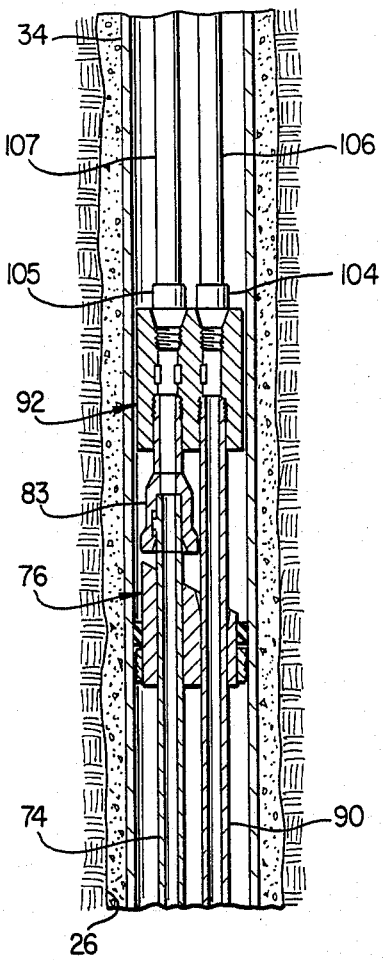
FIG. 12 is a view similar to FIG. 7 showing separate tubing strings extendable from the tubing guide and connector member.

Upon installation of the tubing strings 62, 74 and 90, independent fluid flow paths are provided for the wellbores 24 and 22, respectively. These independent flow paths may be continued to the surface or other desired point in the wellbore 26, as shown in FIG. 12, by the installation of suitable tubing strings 106 and 107, each being connected to the member 92 by respective couplings 104 and 105 connected at the respective threaded portions 95 and 98. Alternatively, as illustrated in FIG. 7, a common flow passage 120 may be formed in the wellbore 26 directly above the member 92 and, for a production well, fluids produced from both wellbores 22 and 24 through a pump 122, if suitable formation conditions exist. The pump 122 may be of a type commercially available and located in the wellbore 26 by a suitable packer 124.

Figure 8:
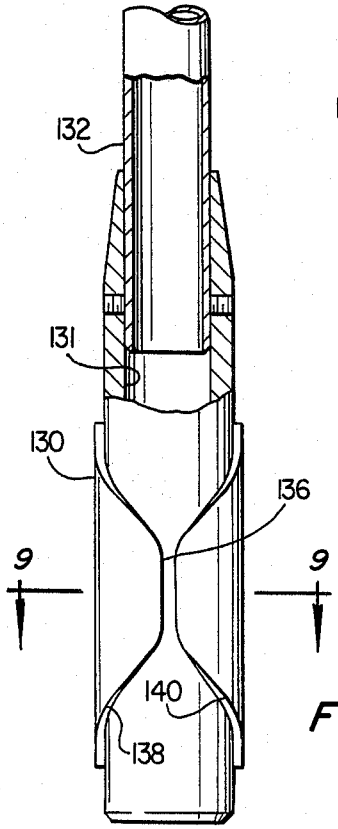
FIG. 8 is a detailed elevation of a guide head assembly for inserting a tubing string into one of the wellbores.
Figure 9:
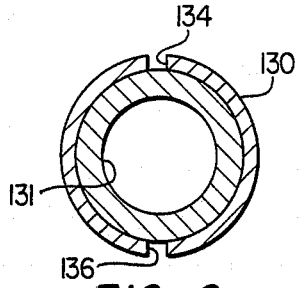
FIG. 9 is a section view taken along the line 9—9 of FIG. 8.

Referring now to FIGS. 8 and 9, well completion and workover or other servicing operations may be carried out in the wellbore 24 by lowering a tubing string into the wellbore 26 and utilizing a guide head 130 suitably connected to the distal end thereof as indicated by the connection of the guide head to the section of tubing 132 in FIG. 8. The guide head 130 has an internal passage 131 extending therethrough and is provided with opposed key slots 134 and 136 formed on the exterior thereof. The keyslots 134 and 136 each have suitable entry guide surfaces 138 and 140, as indicated by way of example for the key slot 136. Accordingly, a tubing string may be lowered into the wellbore 26 and stabbed into the passages in the number 92 until the proper passage is located by registration of the key slots 134 and 136 with the opposed keys 100 which will allow the guide head 130 and the tubing string connected thereto to pass through the member 92.

Figure 11:
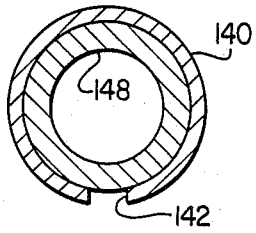
FIG. 11 is a section view taken along the line 11—11 of FIG. 10.
Figure 10:
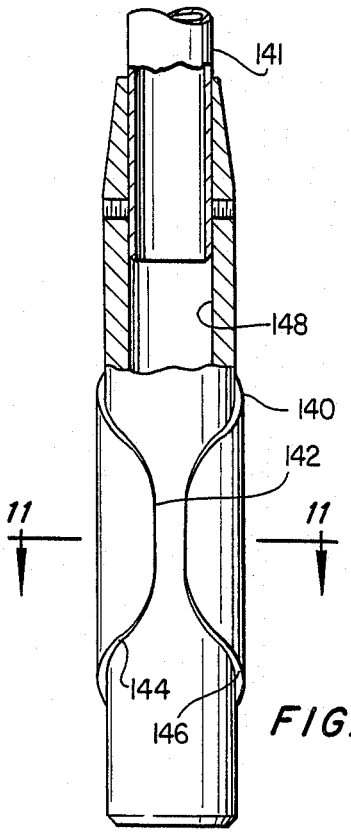
FIG. 10 is a view of another guide head assembly for inserting a tubing string into one of the wellbores.

Referring to FIGS. 10 and 11, a similar guide head 140 may also be connected to a tubing string 141 if it is desired to enter the wellbore 22 for completion or well servicing operations. The guide head 140 has a single key slot 142 formed on the exterior surface thereof with suitable key slot entry guide surfaces 144 and 146 formed thereon. An internal passage 148 is formed in the guide head 140 for conducting fluids between the wellbore 22 and the tubing string 141 upon insertion of the guide head 140 through the passage 96 in the member 92 and the tubing string 90. The abovementioned operations to insert tubing strings into the wellbores 22 and 24 through the respective tubing strings 90 and 62 would typically be carried out in the absence of the pump 122 from the wellbore 26 or any other obstruction in the wellbore, possibly including removal of the packer 124 under certain circumstances.

A preferred method for completing wells represented by the wellbores 22 and 24 will now be described. Certain steps in the improved method include the use of conventional equipment and techniques. Typically the wellbore 24, 26 is formed using conventional drilling practices, although the wellbore 24 may also be formed to be deviated or curved at its lower end. After drilling the wellbore 24, 26 conventional casing 34 is installed with a light alloy or fiberglass section 36 interposed in the casing at the point wherein departure or kick-off of the wellbore 22 is desired. The casing 34 and 36 is cemented in place, using conventional practices, to a point at least above the point of kick-off for the wellbore 22. If the wellbore 24 is to be furnished with a perforated liner or other semi-permanent installation, this equipment is then installed prior to setting the packer 40 in place below the kick-off point for wellbore 22.

After setting the packer 40 in the casing 34, the orientation of the key slots 44 is determined and the whipstock assembly including the whipstock 48 and the anchor 54 is then prepared for installation so that the whipstock guide surface 50 is oriented, upon securement to the packer 40, in the proper direction desired for the wellbore 22. The whipstock 48 is then set in position and the casing 36 milled out followed by drilling of the wellbore 22. After drilling of the wellbore 22, the whipstock retrieval tool 56 is inserted and the whipstock 48 and anchor assembly 54 are retrieved to the surface.

Referring to FIG. 3, an assembly of the lower tubing string 62, the anchor assembly 60, the guide member 64, the tubing member or string 74 and the packer 76 is then made up and lowered into the wellbore until the anchor assembly 60 is locked in registration with the packer 40 with the guide member 64 oriented such that its guide surface 66 is positioned to guide tubing into the wellbore 22, as needed. Upon securement of the anchor assembly 60 in the packer 40, the packer 76 is set and the connector 82 and tubing string 84 are disconnected and retrieved up the wellbore 26.

The tubing string 90 is then run into the wellbore 26 and stabbed into the bore 77 of the packer 76 and through the packer into engagement with the guide surface 66 whereupon the tubing string 90 is then deflected into the wellbore 22. The upper end of the tubing string 90 is connected to the member 92 which is then lowered into the wellbore with the tubing string 106 and the coupling 104. When the tubing string is lowered to the point at which the connector 83 secured to the member 92 locks onto the connector 80 secured to the packer 76, the coupling 104 and tubing string 106 are rotated to disconnect from the member 92 and retrieved from the wellbore 26. The desired completion assembly, such as the single pump 122 and packer 124, or the tubing strings 106 and 107 can then be suitably secured in the wellbore 26 and to the member 92.

Thanks to the provision of the tubing guide and connector member 92, various other operations can be carried out in the wellbores 22 and 24 using the guide heads 140 and 130, respectively, for guiding tubing strings and the like into the respective wellbores. By utilizing either coilable or conventional tubing and the guide heads 130 and 140, selective operations can be carried out in the wellbores 24 and 22 including logging operations, clean-out operations, chemical injection and other treatments.

Conventional engineering materials can be used in fabricating the elements described herein which are not otherwise commercially available, as indicated. Those skilled in the art will recognize that various substitutions and modifications can be made to the particular method and system described without departing from the scope and spirit of the invention as recited in the appended claims.

What we claim is:

1. A system for completing at least two wellbores which have been drilled from a common wellbore, each of said two wellbores having a wellbore portion which is in communication with said common wellbore, said system comprising:

anchor means adapted to be secured in one of said two wellbores;

guide means secured to said anchor means and including a guide surface disposed at the intersection of the other of said two wellbores with said common wellbore for guiding a tubing string and the like into said other wellbore;

packer means insertable in said common wellbore at a point between the earth's surface and said guide means, conduit means extending between said guide means and said packer means for communicating fluid between said one wellbore and said packer means; and a tubing string extending from said packer means and guided into said other wellbore by said guide means.

2. The system set forth in claim 1 including:

a member insertable into said common wellbore and connected to said tubing string for inserting said tubing string into said other wellbore.

3. The system set forth in claim 2 including:

connector means attached to said member for connecting said member to said packer means.

4. The system set forth in claim 3 including:

further conduit means interconnecting said member and said connector means for conducting fluids between said member and said conduit means extending between said guide means and said packer means.

5. The system set forth in claim 2 wherein:

said member includes first passage means in communication with said tubing string and second passage means in communication with said conduit means.

6. A system for completing at least two wellbores which have been drilled from a common wellbore, each of said at least two wells defined by a wellbore which is in communication with said common wellbore, said system comprising:

anchor means operable to be secured in one of said two wellbores;

a guide member secured to said anchor means and including a guide surface disposed at the intersection of the other of said two wellbores with said common wellbore for guiding a tubing string and the like into said other wellbore, said guide member including passage means therein for communicating fluid between said common wellbore and said one wellbore;

packer means insertable in said common wellbore at a point between the earth's surface and said point of intersection of said other wellbore with said common wellbore;

conduit means extending between said guide member to said packer means for communicating fluid between said common wellbore and said guide member;

a passage in said packer means for receiving a tubing string to be insertable through said packer means and to be guided into said other wellbore by said guide member;

a member insertable into said common wellbore and connected to said tubing string for inserting said tubing string into said other wellbore; and means attached to said member for connected said member to said packer means.

7. A method for completing at least two wells which are formed by two wellbores extending from a common wellbore, said method comprising the steps of:

drilling said common wellbore;

drilling said wellbore for one of said at least two wells extending from said common wellbore;

drilling the other wellbore forming the other of said at least two wells;

inserting guide means into said common wellbore and positioning said guide means at the intersection of said wellbores of said at least two wells, said guide means including means for guiding a tubing string into said other wellbore upon insertion of said tubing string through said common wellbore to said guide means, and said guide means including passage means for communicating fluid between said common wellbore and said one wellbore;

inserting said tubing string into said other wellbore by guiding said tubing string into said other wellbore with said guide means;

securing said tubing string in said common wellbore in a predetermined position; and conducting fluids between said two wellbores and said common wellbore.

8. The method set forth in claim 7 including the steps of:

inserting packer means into said common wellbore and positioning said, packer means at a point in said common wellbore between the earth's surface and said intersection; and providing conduit means extending from said guide means at least to said packer means for conducting fluids between said guide means and said packer means.

9. The method set forth in claim 8 wherein:

said packer means includes means for receiving said tubing string to extend through said packer means and said packer means is inserted in said common wellbore before insertion of said tubing string into said other wellbore.

10. The method set forth in claim 7 wherein:

the step of inserting said guide means into said common wellbore is preceded by placing anchor means for said guide means in said one wellbore adjacent the intersection of said two wellbores.

11. A system for completing at least two wellbores which have been drilled from a common wellbore extending from the earth's surface, each of said two wellbores having a wellbore portion which is in communication with said common wellbore, said system comprising:

anchor means adapted to be secured in one of said two wellbores;

guide means secured to said anchor means and including a guide surface disposed at the intersection of the other of said two wellbores and said common wellbore for guiding a tubing string and the like into said other wellbore;

packer means insertable in said common wellbore at a point between the earth's surface and said guide means;

conduit means extending between said guide means and said packer means for conducting fluid between said one wellbore and said packer means;

a tubing string extending from said packer means and guided into said other wellbore by said guide means;

a member insertable into said common wellbore and connected to said tubing string for inserting said tubing string into said other wellbore, said member including first passage means in communication with said tubing string and second passage means in communication with said conduit means, each of said passage means in said member include means for engagement with a guide head insertable in said common wellbore for selectively accepting said guide head for movement through said member and into one of said wellbores.

12. The system set forth in claim 11 including:

a guide head attached to the distal end of a tubing string and including means engagable with cooperating means on said member for selectively receiving said tubing string in one of said passage means.

13. A system for completing at least two wellbores which have been drilled from a common wellbore extending from the earth's surface, each of said two wellbores having a wellbore portion which is in communication with said common wellbore, said system comprising:

anchor means adapted to be secured in one of said two wellbores;

guide means secured to said anchor means and including a guide surface disposed at the intersection of the other of said two wellbores and said common wellbore for guiding a tubing string and the link into said other wellbore;

packer means insertable in said common wellbore at a point between the earth's surface and said guide means;

conduit means extending between said guide means and said packer means for conducting fluid between said one wellbore and said packer means;

a tubing string extending from said packer means and guided into said other wellbore by said guide means;

a member insertable into said common wellbore and connected to said tubing string for insertable said tubing string into said other wellbore, said member including first passage means in communication with said tubing string and second passage means in communication with said conduit means; and respective tubing means coupled to said member for separately conducting fluids through said first and second passage means and said common wellbore.

14. A method for completing at least two wells which are formed by two wellbores extending from a common wellbore, said method comprising the steps of:

drilling said common wellbore;

drilling one wellbore for one of said at least two wells extending from said common wellbore;

placing anchor means in said one wellbore at a point beyond the intersection of one of said wells with said common wellbore;

inserting a drilling guide member in said common wellbore and secured to said anchor means for guiding drilling means to form the other wellbore of said at least two wells;

drilling said other wellbore;

removing said drilling guide member;

inserting guide means into said common wellbore and securing said guide means to said anchor means in a position for guiding a tubing string into said other wellbore, said guide means including passage means for conducting fluid between said common wellbore and said one wellbore;

inserting a tubing string into said other wellbore by guiding said tubing string into said other wellbore with said guide means;

securing said tubing string in said common wellbore in a predetermined position; and conducting fluids between said two wellbores and said common wellbore.

15. The method set forth in claim 14 including the step of:

inserting a tubing string into said one wellbore.

16. The method set forth in claim 15 including the step of:

securing said tubing string in said one wellbore to said anchor means.

17. A method for completing at least two wells which are formed by wellbores extending from a common wellbore, said method comprising the steps of:

drilling said common wellbore;

drilling one wellbore for one of said at least two wells extending from said common wellbore;

drilling the other wellbore forming the other of said at least two wells;

inserting a guide member into said common wellbore and positioning said guide member near the intersection of said wellbores of said at least two wells;

inserting packer means into said common wellbore and positioning said packer means at a point between the earth's surface and said intersection;

providing conduit means extending from said guide member at least to said packer means for conducting fluids between said one wellbore and said common wellbore;

inserting a tubing string through said packer means and into said other wellbore and guiding said tubing string into said other wellbore with said guide member; and securing said tubing string in a predetermined position in relation to said packer means.

18. A method for completing at least two wells which are formed by wellbores extending from a common wellbore, said method comprising the steps of:

drilling said common wellbore;

drilling one wellbore for one of said at least two wells extending from said common wellbore;

drilling the other wellbore forming the other of said at least two wells;

inserting a guide member into said common wellbore and positioning said guide member near the intersection of said wellbores of said at least two wells in a position for guiding a tubing string into said other wellbore;

inserting packer means into said common wellbore an positioning said packer means at a point between the earth's surface and said intersection;

providing conduit means extending from said guide member at least to said packer means for conducting fluids between said one wellbore and said common wellbore;

inserting a tubing string through said packer means and into said other wellbore and guiding said tubing string into said other wellbore with said guide member; and securing said tubing string in a predetermined position in relation to said packer means by providing a tubing means guide member connected to said tubing string for guiding tubing means selectively into one of said conduit means and said tubing string and connecting said tubing means guide member to said packer means upon installation of said tubing string into said other wellbore.

* * * * *

UNITED STATES PATENT AND TRADEMARK OFFICE

CERTIFICATE OF CORRECTION

PATENT NO. : 4,807,704

DATED : Feb. 28, 1989

INVENTOR(S) : Frank H. Hsu and James A. Dech

It is certified that error appears in the above-identified patent and that said Letters Patent is hereby corrected as shown below:

Column 8, line 21, delete "connected" and insert --- connecting ---.

Column 8, line 27, delete "said" (first occurrence) and insert --- one ---.

Column 8, line 51, delete the comma after the first occurrence of "said".

Column 9, line 51, delete "link" and insert --- like ---.

Column 9, line 64, delete "insertable" and insert --- inserting ---.

Column 11, line 10, delete "an" and insert --- and ---.

Signed and Sealed this

Twenty-ninth Day of August, 1989

*Attest:*

*Attesting Officer*

DONALD J. QUIGG

*Commissioner of Patents and Trademarks*